United States Patent [19]

Montali et al.

[11] Patent Number: 4,854,511

[45] Date of Patent: Aug. 8, 1989

[54] DEVICE AND METHOD FOR INTERMITTENTLY STORING AND RETURNING YARN DURING THE WINDING OF CONICAL BOBBINS FED WITH YARN AT CONSTANT SPEED

[75] Inventors: Sergio Montali, Roveredo in Piano; Giorgio Boller, Treviso; Luigi Colli, Pordenone, all of Italy

[73] Assignee: Savio SpA, Pordenone, Italy

[21] Appl. No.: 170,279

[22] Filed: Mar. 18, 1988

[30] Foreign Application Priority Data

Mar. 19, 1987 [IT] Italy ..... 19762 A/87

[51] Int. Cl.[4] ..... B65H 54/42; B65H 59/38

[52] U.S. Cl. ..... 242/18 DD; 242/45; 242/154

[58] Field of Search ..... 242/18 R, 18 DD, 18 CS, 242/45, 147 R, 153, 154, 25 R

[56] References Cited

U.S. PATENT DOCUMENTS

| | | | |
|---|---|---|---|
| 2,102,109 | 12/1937 | Brueggemann | 242/45 |
| 3,300,161 | 1/1967 | Hermanns | 242/154 |
| 3,640,477 | 2/1972 | Furst | 242/18 DD X |
| 4,002,306 | 1/1977 | Raasch | 242/18 DD X |
| 4,019,691 | 4/1980 | Wroclaski et al. | 242/45 |
| 4,083,506 | 4/1978 | Mander et al. | 242/25 R |
| 4,113,193 | 9/1978 | Raasch et al. | 242/18 DD X |
| 4,120,462 | 10/1978 | Raasch et al. | 242/45 |
| 4,133,493 | 1/1979 | Schewe | 242/154 |
| 4,312,482 | 1/1982 | Schewe | 242/154 |

FOREIGN PATENT DOCUMENTS

| | | | |
|---|---|---|---|
| 2721972 | 11/1978 | Fed. Rep. of Germany DD | 242/18 |
| 8527472 | 11/1985 | Fed. Rep. of Germany . | |
| WO80/01272 | 6/1980 | PCT Int'l Appl. . | |
| 2125072 | 2/1984 | United Kingdom . | |

*Primary Examiner*—Stanley N. Gilreath

*Attorney, Agent, or Firm*—Hedman, Gibson, Costigan & Hoare

[57] ABSTRACT

A yarn storage and return device for yarn being wound on a conical bobbin driven at a constant speed. The device comprises a lever system for speed. The device comprises a lever system for storing and returning the yarn and for regulating and monitoring the amount of stored yarn. The yarn is drawn into the storage position by an arm of the lever system and is then released (i.e. returned) from this storage position. This returning operation releases the yarn from its storage position and replaces it (returns it) to its normal feed path. The device also comprises a transducer, and electric comparator, and an electric processor control unit to convert, compare and process an electrtic controlling signal to activate a drive source. The drive motor actuates a tensioning element which affects the storage operation of the device. The device further comprises a bidirectional drive unit to obtain a variation in the average yarn winding speed to restore the storage operation to a predetermined range of values.

5 Claims, 1 Drawing Sheet

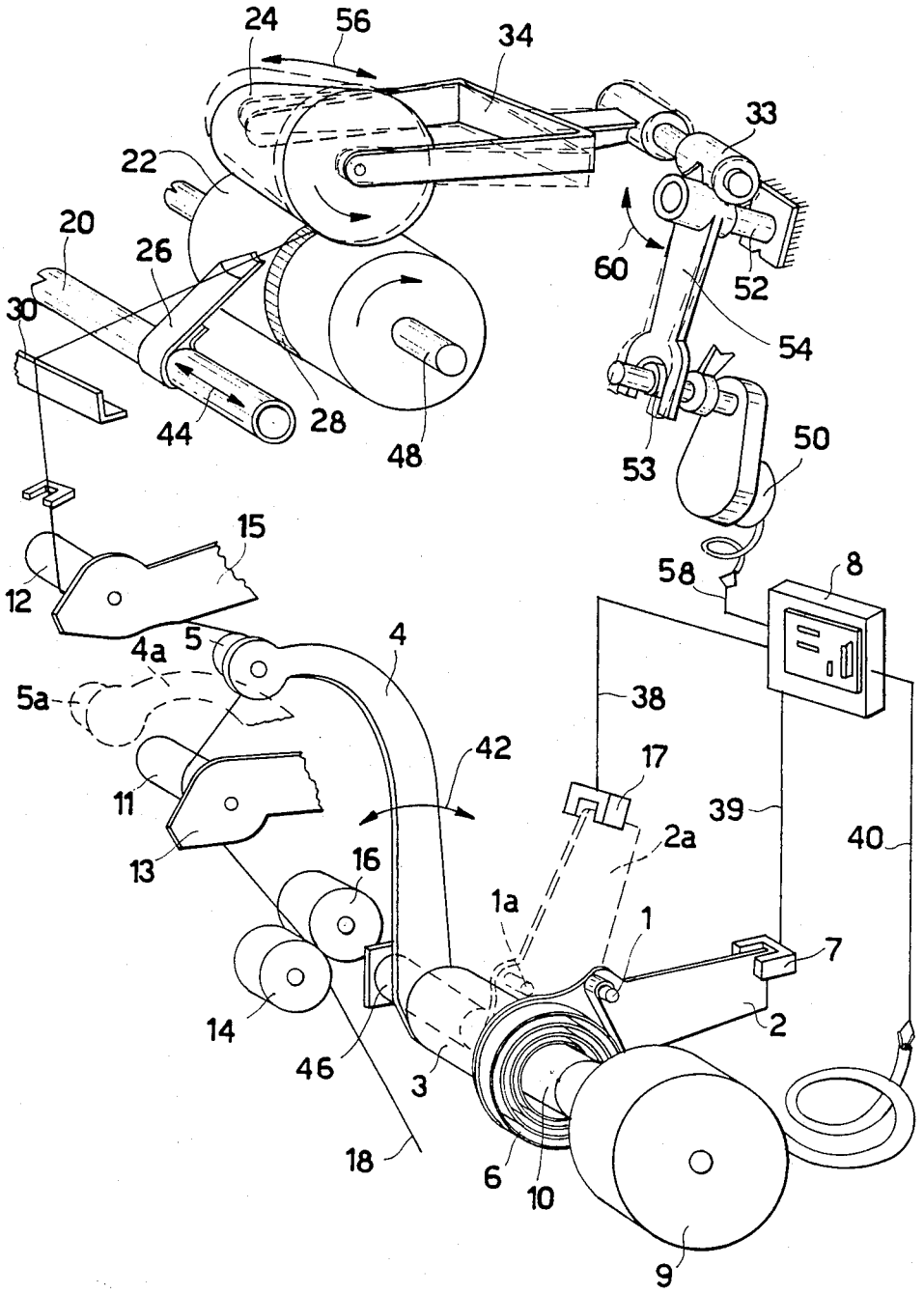
24
56
34
33
22
20
26
60
52
30
54
44
28
48
53
50
15
58
8
12
4a
5
4
5a
38
42
17
11
39
2a
40
13
16
1a
1
7
14
2
46
3
18
6
10
9

DEVICE AND METHOD FOR INTERMITTENTLY STORING AND RETURNING YARN DURING THE WINDING OF CONICAL BOBBINS FED WITH YARN AT CONSTANT SPEED

The invention relates to a device and method for intermittently storing and returning yarn during the winding of conical bobbins with yarn withdrawn at constant speed from individual spinning units. More particularly, the invention relates to a yarn storage and return device in which a store for the intermittent supply of yarn and a tension compensator and regulator for the yarn being wound are combined.

In spinning units, the yarn emerges at their outlet at constant speed from the feed rollers and must be deposited at a speed which varies between the major diameter and minor diameter of the conical bobbin being formed.

In such an operational process it is therefore necessary to periodically vary the yarn length in the section between the feed rollers and its point of deposition on the circumference of the conical bobbin. This length variation and the consequent variation in yarn tension are compensated by adjusting the yarn path by means of a winding tension regulator and compensator device.

Tension compensators are known in the art. They comprise a deflecting roller connected to a rocker arm. Depending on the instantaneous yarn tension, or rather according to the instantaneous position of the rocker arm, the mobile deflecting roller is deviated to a varying extent from its contact or bearing position, this position being assumed by the action of a force exerted by a counterweight, a spring or a similar elastic element. These yarn tension compensators have the drawback of exerting an elastic opposing force which cannot be controlled in respect of the tension variations which can occur in the yarn in the case of non-regular storage.

In said devices a constantly rotating substantially cylindrical drive roller rotates the conical bobbin under formation, the dimensions of which, together with the taper and angle of the winding helix determine the angular swing amplitude of the mobile arm.

The swing position of this latter, which keeps a roller connected to it constantly adhering to the yarn, represents the yarn storage value, which constantly increases and decreases according to the stage in the progress of the entire yarn storage and return cycle. Any slippage between the control roller and bobbin under formation, which is frequently present due to the friction drive used, increases the length of yarn stored and changes the swing position of the mobile arm which, under the action of the elastic element acting in a pulling capacity, is moved in the limit into an abutting position, consequently nullifying the tensioning of the yarn being collected. Thus without tension, the yarn leaving the winding rollers winds with irregular turns, so prejudicing the bobbin formation and in the limit twisting about itself to create loops and tangles such as to compromise the yarn consistency. The tangled yarn also frequently creates obstacles such as to interrupt yarn continuity, so blocking the spinning process. The high yarn formation rate means that any production hold-up in such spinning units assumes considerable importance because of the reduced rate of yarn collection on the bobbins.

Yarn tension compensators of this type also have the drawback that if the yarn count or thickness, the type of bobbin under formation or the winding helix angle varies, they have to be adapted to this by onerous manual adjustments to the individual spinning stations, or by replacing the elastic element with another elastic element which conforms to the different operating characteristics. These devices are therefore inflexible in use.

Devices for storing and intermittently returning yarn, preferably for textile machines, are also known. These include by way of example the devices described and claimed in the German patents DE No. 1785153 and DE No. 1454917.

Such devices have numerous drawbacks: they are insensitive to tension and even less to tension variations in the winding yarn because the storage and return element is of a type which, by means of a lever system, is completely controlled by a to-and-fro drive rod which passes along the entire machine face to operate the yarn stores of all the spinning units. They are unable to adjust the yarn tension to one or more predetermined values preset according to the type of yarn being collected or of the bobbin under formation. They present considerable difficulty in adjusting the value preset for the storage of the yarn being wound, as this adjustment must be made manually by an operator by adjusting the length of the connecting rods or the positions of the lever rotation pivots in order to vary the lever arms, and is therefore lengthy and laborious; they also have a rather high inertia force due to the presence of several lever systems which are mobile simultaneously but intermittently, and tend to trigger uncontrollable vibratory oscillation and at the same time limit the collection rate. They also set limits on the machine length and therefore on the number of spinning units as their operation relies on drive rods which have to extend along the face of the collection units and are subjected to large numbers of to-and-fro movement strokes. These devices are also rather bulky and inefficient when slippage is present between the conical bobbin under formation and the control roller. This slippage, which is more or less accentuated, is often present because the conical bobbin being cross-wound continuosly rests against a drive roller which on a determined but narrow part of its surface possesses a friction band for friction drive purposes.

A further drawback of such devices is the presence of mobile members, such as rods or shafts, which have to be provided and mounted at the commencement of machine construction, and cannot be economically fitted later.

Said mobile members control the operation of several storage devices and extend along the entire winding face from a position at the head of the machine. Because of the principle on which they are constructed, these devices are inflexible and unadaptable to pre-existing spinning stations or stations not provided with the aforesaid mobile members which pass along the front structure of the entire collection face.

An object of the present invention is to obviate the aforesaid drawbacks by providing a storage and intermittent return device wherein yarn is drawn into the storage position and is then released from this storage position (i.e. returned). This returning operation releases the yarn from its storage position and replaces it (returns it), to a normal feed path. This device, winding conical bobbins fed with yarn at constant speed has the following advantages:

enables the stored length to be always maintained within a preset range of values with only limited variations in yarn tension allows the immediate takeup of any additional yarn lengths accidentally present due to slippage between the drive roller and conical bobbin under formation does not limit the yarn collection speed in the formation of conical bobbins does not set limits on the machine length and thus does not limit the number of winding units to be positioned side by side, as these do not require for their operation any drive member extending along the entire winding face, and therefore do not possess further masses moving longitudinally to the machine and connected to drive rods subjected to reciprocating to-and-fro movement does not limit the diameter of the bobbins obtainable and does not require laborious adjustment to be made when changing the taper of the bobbin under formation has extreme operational flexibility such as to allow a range of application which enables soft or compact bobbins to be made up within a vast range of yarn counts without the need for laborious mechanical adjustments can be applied without the need for extensive demounting and remounting of the component parts of the winding machine if this, being already set for forming cylindrical bobbins, is to be converted for forming conical bobbins can be easily disengaged so as to make it possible to form both conical and cylindrical bobbins on the same machine.

A further object of the present invention is to provide a yarn storage and return device in which a store for the intermittent feed of yarn and a tension compensator and regulator for the yarn being wound are combined, in a manner requiring very little maintenance.

These and further objects are all attained by the yarn storage and return device of the present invention, in particular for textile machines operating to form conical bobbins, characterised by comprising:

a double arm lever system having the ability to move with swing motion about an axis by means of a bush positioned as a rigid element joining together said arms, of which one operates as a yarn storage and return element and, at the same time, as a tension compensator and regulator element for the yarn being wound, and the other operates as a linear position element of a system for controlling and monitoring the effective yarn storage during the to-and-fro cycle of the yarn guide element an analog or digital transducer which converts the position of the end of the arm operating as a linear position element into an electrical signal or series of electrical signals an electrical comparator which compares said electrical signal or said electrical signals with one or more reference signals, these latter being related to predetermined values preset to give regular storage, in order to generate an electrical output signal when a signal arises which is of a value different from the preset value or values an electronic control unit, in the form of a processor means of known type, which receives said electrical output signal and processes it in order to generate an electrical control signal which activates the operation of a drive source, said control signal subsequently activating a bidirectional drive unit if non-regular storage swings persist a drive source which, under the influence of said control signal provided by the electronic control unit, increases or decreases the preloading of the spiral elastic element in order to adjust the storage arm to a yarn tensioning value which is slightly higher or slightly lower than its previous value, in order to restore the storage swing to within the range of values corresponding to regular storage, this latter being predetermined as a function of the geometrical parameters of the winding underway a bidirectional drive unit which, after having been activated by the persistence of non-regular storage swing, inclines the axis of the conical bobbin, so displacing the diameter of effective contact between the bobbin and drive roller to consequently obtain a variation in the average yarn winding speed in order to restore the storage swing to within the range of values corresponding to regular storage.

Thus, the yarn is drawn into the storage position when the tension is low and subsequently released from this storage position, i.e. returned, when the tension is high. This returning operation releases the yarn from its storage position and replaces it (returns it), to its normal feed path.

According to one embodiment, the device is present individually in each yarn winding position.

According to a further embodiment, the device has no mechanical link with the yarn guide element, and is not dependent on the support element for the bobbin under formation or on the fullness of the bobbin itself.

The device according to the invention has the advantage, for any variation in the type of yarn and for any variation in the geometrical characteristics of the winding or of the type of bobbin to be obtained, of automatically adjusting and setting the tension of the yarn being collected to a corresponding value for obtaining regular storage and return swings in accordance with the preset values and limits.

A further advantage of the invention is that it ensures that once actuated by the drive source, the rotations in both directions for the purpose of varying the preloading of the elastic element are perfectly irreversible so that the reaction of the elastic element against the shaft or the vibration of the machine when in operation are unable to minimally modify the extent of said actuated rotations.

The device according to the invention also has the further advantage, for any undesired variation in the position of the effective drive diameter, of automatically restoring the correct position of the effective drive diameter for regular winding of the conical bobbin under formation.

A preferred embodiment of the device of the present invention is described hereinafter by way of non-limiting example with reference to the single accompanying figure.

This is a diagrammatic isometric view of the storage and intermittent return device of the present invention cooperating with the yarn guide element, the bobbin under formation being driven by the friction band of the drive roller, the figure showing the moment of maximum storage in the yarn travel while the yarn guide element is moving in the increasing diameter direction of the cross-wound bobbin.

In the single figure: the reference numeral 1 indicates the connection pin of the spiral elastic element 6. Said pin 1 is rigidly fixed in an integral manner to the mobile arm 2; 1*a* is the position which the pin 1 assumes in its swing movement; 2 is the mobile arm of the yarn compensation and return lever system, which operates as the linear position element of a system for controlling and monitoring the storage; 2a is the position which the mobile arm 2 assumes at that moment during its swing movement when the stored yarn length 18 is zero or a minimum; 3 is the bush or ring which rigidly joins together the two mobile arms 2 and 4 of the yarn storage and return lever system; 4 is that mobile arm of the yarn compensation and return lever system which operates as the actual storage and return element for the yarn 18 while also acting as the tension compensation and adjustment element for the yarn 18 being wound; 4a is the position which the mobile arm 4 assumes at that moment during its swing movement when the stored yarn length 18 is zero or a minimum; 5 is a mobile yarn deflecting and guide roller rigid with the end of the mobile arm 4 but is able to rotate about itself so as not to generate grazing friction against the yarn undergoing continuous collection. It has a substantially cylindrical profile; 5a is the position which the mobile yarn deflecting and guide roller 5 assumes at that moment during its swing movement when the stored yarn length 18 is zero or a minimum; 6 is the spiral elastic element which stores drive energy by means of appropriate deformation resulting from the angular rotation applied by the shaft 10 which is connected to its inner end. It consists of a steel strip or wire or similar steel shape, wound substantially as a flat Archimedes spiral; 7 and 17 are two position transducers of optical, magnetic, analog or digital type.

Said transducers convert the position of the end of the mobile arm 2 into an electrical signal or a series of electrical signals; 8 is a central unit which combines an electrical comparator with an electronic microprocessor. Said central unit processes the data originating from the transducers, to then activate a drive source 9 when regularizing the storage of yarn 18; 9 is the drive source which operates the shaft 10; 10 is a shaft rotated angularly by the drive source 9 to vary the preloading of the spiral elastic element 6 for the purpose of regularizing the storage if this has strayed outside the range of preset values. Said shaft is fixed or hinged, at or in proximity to its end, to the inner end of the spiral elastic element 9; 11 is a fixed yarn deflecting and guide roller having a substantially cylindrical profile and connected rigidly to the base plate 13. It is free to rotate about itself in order not to generate grazing friction against the yarn 18 undergoing continuous collection movement; 12 is a fixed yarn deflecting and guide roller of substantially cylindrical profile connected rigidly to the base plate 15. It is free to rotate about itself; 13 is the base plate for the roller 11, and is fixed to the machine structure, not shown on the FIG. 15 is the base plate for the roller 12 and is fixed to the machine structure, not shown on the FIGS. 14 and 16 indicate a pair of rollers positioned along the path of the yarn 18, both rollers being pressed against each other with said yarn 18 passing between them to withdraw it at constant speed from a spinning unit of a rotor spinning machine and feed it from its outlet towards the compensator device of the present invention; 18 is the collected yarn subjected to storage and return at the outlet of the pair of feed rollers 14 and 16; 20 is a solid or hollow shaft of substantially circular cross-section which is operated as a control rod for the yarn guide elements 26 by means of a suitably shaped cam so as to transmit a movement of suitable kinematic and dynamic characteristics to said thread guide elements 26; 22 is the drive roller for rotating the conical bobbin 24 under formation; 24 is the cross-wound yarn bobbin under formation; 26 is the yarn guide element driven with reciprocating to-and-fro motion by the drive shaft or rod 20, this latter extending along the entire operational winding face; 28 is the friction region in the form of a narrow circular band, for driving a conical bobbin by the drive roller 22; 30 is a blade for deflecting the path of the yarn 18.

Said blade can be linear or shaped with more or less accentuated profiles already known to the art; 34 is the bobbin carrier arm which supports the yarn bobbin 24; 38 and 39 are the connection cables between the transducers 7 and 17 and the central unit 8; 40 is the connection cable between the central unit 8 and the drive source 9; 42 indicates the swing path of the mobile arm 4; 44 indicates the reciprocating to-and-fro movement path of the shaft 20; 46 is the shaft or pivot about which the yarn storage and intermittent return lever system swings by way of the bush coupling 3; 48 is the drive shaft which extends along the entire winding face; 50 is the bidirectional drive unit consisting preferably of a stepping motor which inclines the axis of rotation of the conical bobbin in one direction or the other in order to vary the line of effective contact to consequently obtain a controlled variation in the winding speed of the yarn 18; 52 is the pivot about which the bobbin carrier arm 34 rotates by virtue of the rotary movement of the bidirectional drive unit 50; 53 is the cam keyed onto the output shaft of the drive unit 50, the rotation of which determines the angular displacement of the lever 54, rotatably mounted on the pivot 52, and consequently the variation in the inclination of the bobbin carrier arm 34; 56 is the line representing the inclination of the axis of rotation of the conical bobbin 24 to a substantially vertical plane containing the axis of the drive roller 22; 58 is the connection cable between the central unit 8 and the drive source of the bidirectional drive unit 50; 60 is the line representing the angular rotation in both directions of the pivot 52; 33 is the transverse hub rigid with the lever 54.

The operation of the device according to the invention is as follows.

The purpose of the storage and return device for the yarn 18 being wound onto the conical bobbin 24, according to the invention, is to adapt the varying winding speed deriving from the taper of the bobbin 24 to the constant outlet speed from the feed rollers 16 and 14. The average winding speed corresponds substantially to the spinning speed of the spinning chaber. When the yarn 18 is being collected on the minor diameter of the bobbin 24 the winding speed is less than the feed speed from the extracting rollers 14 and 16, and the lever system by means of its mobile arm 4 stores a suitable length of yarn 18. This stored length is returned gradually as the collection speed increases on moving the yarn towards the major diameter of the bobbin 24 by means of the yarn guide element 26.

The ratio of the minor diameter to the major diameter of the bobbin 24 under formation determines the maximum length of yarn 18 which has to be stored and then retuned for each complete cycle of the yarn guide element 26.

As said ratio decreases continuosly with increasing fullness of the bobbin 24 under formation, the amplitude of the swing movement of the mobile yarn deflecting and guide roller 5 also decreses for decreasing storage of yarn 18.

The mobile deflecting roller 5 generates a loop by deflecting the yarn 18 from its path. This loop therefore has a continuously varying amplitude and the device of the present invention is automatically controlled in accordance with this variation, to act as a compensator for the periodic tension variations which arise as a result of the periodic winding speed variations in the formation of a conical bobbin.

In order to compensate said tension variations to which the collected yarn 18 is subjected and level them out to a substantially constant value, the mobile deflecting roller 5, which drags the yarn into a temporary storage loop by means of the swing movement of the mobile arm 4, has to assume different positions relative to the fixed deflecting rollers 11 and 12, within a certain range of swing.

These latter deflecting rollers, besides being rotatable about themselves, must provide precise guiding of the yarn 18 by virtue of their shape.

Because of the rigid connection between the two mobile arms 2 and 4, this variation in the position of the mobile deflecting roller 5 also varies the position of the end of the lever 2.

Said end interacts with the linear position transducers 7 and 17 without the need for mutual contact, these latter generating at their output a signal or several signals of electrical nature which are fed through the connection cables 38 and 39 to the central unit 8 which compares and processes said signals. If during the continuous winding process the storage swing remains within the predetermined limits preset by the position of the two transducers, the central unit 8 confirms that the storage and return cycles of the yarn 18 are regular. Thus no signal is generated at the output of the central unit 8 and no activation signal is therefore fed to the drive source 9. If during the continuous winding process the storage swing strays outside the predetermined preset limits, the corresponding mobile linear position of the end of the arm 2 is such as to cause the transducers 7 and 17 to generate an electrical signal or signals which after suitable comparison and processing in the central unit 8 give instant rise to an output signal which activates the drive source 9. This latter angularly rotates the shaft 10 to vary the preloading of the spiral elastic element 6 in order to rapidly return the storage to within the limits of the predetermined preset range.

This latter operation can be further clarified as follows. If the mobile deflecting roller 5 causes the loop in the yarn 18 to assume a position which exceeds the maximum storage limit allowed by the range of swing predetermined for regular operation, the drive source 9 is operated and rotates the shaft 10 angularly in the direction which slightly reduces the amount of preloading of the spiral elastic element 6. This latter element therefore slackens and compels the yarn, by means of the lever system 2, 3, 4 and 5, to collect on the conical bobbin under an average tension which is slightly lower than the preceding situation. This reduction in the average tension of the yarn 18 being continuously wound must be sufficiently gradual to not allow the formation of knots, tangles or similar defects which if collected on the bobbin would reduce its quality.

By only slightly decreasing the average tension of the yarn being wound, the yarn slackens and becomes less inserted into the already deposited layers of yarn, and therefore proceeds to wind in the form of turns having a slightly greater diameter.

These turns rapidly and progressively take up the excessive storage created by a multiplicity of factors.

If the mobile deflecting roller 5 causes the loop in the yarn 18 to assume a position below the minimum storage limit allowed by the range of swing predetermined for regular operation, the drive source 9 is operated and rotates the shaft 10 angularly in the direction which slightly increases the amount of preloading of the spiral elastic element 6. This latter element therefore tightens and compels the yarn, by means of the lever system 2, 3, 4 and 5, to collect on the conical bobbin under an average tension which is slightly higher than the preceding situation. This increase in the average tension of the yarn 18 being continuously wound can be substantially rapid as there is no danger of forming knots, tangles or similar defects. By only slightly increasing the average tension of the yarn being wound, the yarn tightens and becomes more inserted into the already deposited layers of yarn, and therefore proceeds to wind as turns having a slightly smaller diameter. Such turns rapidly and progressively cause the yarn to store in the form of an increasingly larger loop, with the result that the intermittent swing of the mobile arm 4 again falls within the limits of the range of swing for regular operation.

It is well known that the yarn tension can only be allowed to fluctuate within a fairly narrow range. On the one hand, the yarn tension must not assume such values as to compromise the integrity and elasticity of the yarn itself, and on the other hand must not fall below values which allow the formation of twists or knots or similar entanglement defects. The yarn storage and return arm must obviously operate within the range of regular tension values, ie those which do not lead to the aforementioned drawbacks.

As is apparent from the aforesaid, the swing movement of the storage lever system subjected to the action of the spiral elastic element 6 may be insufficient or only partly sufficient to restore the intermittent swing to within the range corresponding to regular storage. To ensure that even in such cases regular swing motion is restored, a bidirectional drive unit is operated after a sufficiently short time in order to incline the axis of the conical bobbin 24 so as to vary the average winding speed.

If non-regular storage swings still persist immediately after the spiral elastic element has reached its upper or lower preloading limit, the central unit 8 immediately produces an output electrical control signal which activates the bidirectional drive unit 50. The aforesaid limits to the preloading of the elastic element 6 are related to the limiting tensioning and slackening values allowed by the technical characteristics of the type of yarn being wound.

On receiving the activation signal, said bidirectional drive unit 50 rotates the cam 53 which, by way of the corresponding mechanical elements 54 pivoted on the pivot 52, transmits an angular rotation to the bobbin carrier arm 34 to incline the axis of rotation of the conical bobbin in one direction or the other, and consequently displace the diameter of effective contact between the bobbin 24 and drive roller 22 to obtain a suitable variation in the average winding speed of the yarn 18 in order to restore the storage swing to within the range of values corresponding to regular storage.

This latter operation can be further clarified as follows. If the mobile deflecting roller 5 causes the loop in the yarn 18 to assume a position which exceeds the maximum preset storage limit, the position of the mobile arm 2 causes the transducer 7 to generate an electrical output signal corresponding to said position.

Said electrical output signal is fed to the central unit 8 through the connection cable 39. The central unit 8, after identifying the type of electrical signal received from the transducer, correspondingly produces at its output a specific electrical control signal, which is fed through the connection cable 58 to activate the bidirectional drive unit 50. Said unit transmits an angular anticlockwise rotation to the bobbin carrier arm 34, which consequently displaces the diameter of effective contact between the bobbin 24 and the drive roller 22 in the decreasing diameter direction, ie towards the minor base of the bobbin.

Thus the average winding speed increases, ie settles at an average value which is slightly higher than the previous average value, so causing rapid and progressive takeup of the excessive storage created by a multiplicity of factors.

As the layer of yarn present on the conical base tube on which the yarn winds is sufficiently soft and therefore deformable, this displacement of the contact diameter or band takes place gradually as allowed by the stepping motor 50. If the mobile deflecting roller 5 causes the storage loop in the yarn 18 to assume a position which lies below the preset minimum storage limit, the position of the mobile arm 2 causes the transducer 17 to generate an electrical output signal of value corresponding to said position.

Said electrical output signal from the transducer 17 is fed to the central unit 8 through the connection cable 38. The central unit 8, after identifying the type of electrical signal received from the transducer, correspondingly produces at its output a specific electrical control signal, which is fed through the connection cable 58 to activate the bidirectional drive unit 50. Said unit transmits an angular clockwise rotation to the bobbin carrier arm 34, which consequently displaces the diameter or band of effective contact between the bobbin 24 and the drive roller 22 in the decreasing diameter direction, ie towards the major base of the conical bobbin. Thus the average winding speed decreases, ie settles at an average value which is slightly lower than the previous average value, so causing the yarn to be progressively stored in a loop of continuously increasing size, with the result that the intermittent swing of the mobile flat element 4 is restored to within the predetermined regular range preset by the positions assumed by the mobile arm 2.

The width of said regular range is predetermined by the geometrical characteristics of the winding being made together with the characteristics of the yarn and conical bobbin 24 under formation.

It has been found that the device for intermittently storing and returning yarn during the winding of conical bobbins fed with yarn at constant speed operates very reliably, and periodically compensates the variations in yarn tension without the mobile deflecting roller 5 undergoing uncontrollable swing. The use of the device according to the invention is not limited to the winding of conical bobbins produced on spinning units, but can also be advantageously applied to the winding of conical bobbins or packages on any winding unit.

A preferred embodiment has been described herein but it is apparent that other embodiments are possible which fall within the scope of the present invention.

Thus the positions of the operating lever systems can vary; different drive arrangements can be provided; it is also possible to vary the shapes and dimensions of the yarn deflecting-storage roller together with the arms which undergo swing movement; ratios and dimensions of the various operational elements can also vary; modifications of a practical applicational nature can be made, thus for example any type of mechanical, electrical, magnetic or optical transducers can be used; the position of the storage lever system can also be sensed by an optical rod or bar, or by one or more optical sensors in cooperation with bar codes; this latter position, which is converted into an electrical signal and processed as heretofore described, can also be sensed on a circumferential arc close to or in correspondence with the axis of rotation of the storage lever system so as not to be influenced by any small vibrations which arise during passage of the yarn.

Obviously the various processed signals can be functions of other physical quantities related to the aforesaid, in that the arrangement of the various units of the device can be easily modified according to the various types of quantities to be processed or compared. Numerous modifications can be made to the invention thus conceived.

Thus, the bidirectional drive unit 50 for inclining the bobbin carrier arm can consist of pneumatic or electromagnetic actuators or electric motors, which can act either by directly rotating the arm or by rotating specific cams and lever systems in the two directions. Moreover, all details can be replaced by other technically equivalent elements; all without leaving the scope of the inventive idea as claimed hereinafter.

We claim:

1. A yarn storage and return device for yarn being wound on a conical bobbin driven at a constant speed by drive means in contact therewith, comprising:

(a) a lever system including a shaft, an elastic element, and a pair of arms, which are connected to and move with each other, through which said shaft passes, and which can swing around the axis defined by said shaft, one of said arms having a deflecting roller and acting as a yarn storage and return means and a tension compensator and a regulator for the wound yarn, and a second arm operating as a linear positioning element for controlling and monitoring the effective length of yarn stored during the entire bobbin formation;

(b) a transducer responsive to the position of said second arm for converting the position of the first storage and return arm into one or more signals for indicating the position of said first storage and return arm;

(c) an electronic comparator for comparing said electrical signal of said transducer with one or more reference signals which define the predetermined range of swing of said first storage and return arm for generating a control signal when the range of swing is outside the predetermined range;

(d) an electronic control processor unit for converting said control signal generated by said comparator into an activating signal;

(e) a drive source for adjusting the loading on said elastic element according to said activating signal from said electronic control processor unit for varying the tension of said first storage and return arm to restore the swing of said arm to within its predetermined range; and (f) a bidirectional drive unit responsive to said electronic control processor unit for displacing the contact between the bobbin and its drive means by inclining the axis of the bobbin for obtaining a variation in the average yarn winding speed for restoring the swing of said storage and return arm within its preset range.

2. The device of claim 1, wherein the elastic element is spiral.

3. In an apparatus for winding yarn on a conical bobbin driven at a constant speed, by drive means in contact therewith including a guide for guiding the yarn onto the bobbin and a support for supporting the bobbin, a device for storing and returning yarn being wound on the bobbin independent of said guide and said support, wherein the device comprises:

(a) a lever system including a shaft, an elastic element, and a pair of spaced apart arms which are rigidly joined by a bushing through which said shaft passes, and which can swing around the axis defined by said shaft, one of said arms having a deflecting roller and acting as a yarn storage and return means and a tension compensator and a regulator for the wound yarn, and a second arm operating as a linear positioning element for controlling and monitoring the effective length of yarn stored during the entire bobbin formation;

(b) a transducer responsive to the position of said second arm for converting the position of the first storage and return arm into one or more signals for indicating the position of said first storage and return arm;

(c) an electronic comparator for comparing said electrical signal of said transducer with one or more reference signals which define the predetermined range of swing of said first storage and return arm for generating a control signal when the range of swing is outside the predetermined range;

(d) an electronic control processor unit for converting said control signal generated by said comparator into an activating signal;

(e) a drive source for adjusting the loading on said elastic element according to said activating signal from said electronic control processor unit for varying the tension of said first storage and return arm to restore the swing of said arm to within its predetermined range; and (f) a bidirectional drive unit responsive to said electronic control processor unit for displacing the contact between the bobbin and its drive means by inclining the axis of the bobbin for obtaining a variation in the average yarn winding speed for restoring the swing of said storage and return arm within its preset range.

4. The device of claim 1, wherein the bidirectional drive unit is a stepping motor.

5. A method for storing and returning yarn being wound on a conical bobbin driven at a constant speed by drive means in contact therewith, comprising:

(a) driving a lever system means having a storage and return arm means and a linear positioning element means for storing and returning yarn for compensating and regulating the wound yarn for controlling and monitoring the amount of yarn stored during bobbin formation, and for generating a balancing counterforce to the tension of said wound yarn;

(b) converting the position of said yarn storage and return means of said lever system into one or more electrical signals by a transducer means for indicating the position of said storage and return means;

(c) comparing said electrical signals of said transducer means with one or more reference signals and generating a control signal by an electric comparator means when the range of swing is outside the range defined by said reference signal;

(d) converting said control signal from said electric comparator means into an activating signal by an electronic control processor unit means;

(e) adjusting the loading of a spiral elastic element of said lever system means by a drive source means according to said activating signal from said electronic control processor unit means; and (f) displacing the contact diameter between the bobbin and its drive means by inclining the axis of the bobbin for obtaining a variation in the average yarn winding speed for restoring the swing of said storage arm to within its preset range.

* * * * *